US006588958B1

(12) United States Patent
Seidler

(10) Patent No.: US 6,588,958 B1
(45) Date of Patent: Jul. 8, 2003

(54) AIRTIGHT MAGNETIC APPLICATOR SYSTEM

(75) Inventor: David Seidler, Forest Hills, NY (US)

(73) Assignee: Concept Workshop Worldwide, LLC, New York, NY (US)

( * ) Notice: Subject to any disclaimer, the term of this patent is extended or adjusted under 35 U.S.C. 154(b) by 0 days.

(21) Appl. No.: 10/114,631

(22) Filed: Apr. 2, 2002

(51) Int. Cl.[7] ..... B43K 5/16
(52) U.S. Cl. ..... 401/100; 401/17; 401/31
(58) Field of Search ..... 401/100, 121, 401/99, 122, 17, 31; 132/317

(56) References Cited

U.S. PATENT DOCUMENTS

| | | | |
|---|---|---|---|
| 230,120 | A | 7/1880 | French |
| 2,849,738 | A | 9/1958 | Hopkins |
| 2,866,993 | A | 1/1959 | Edelstone |
| 2,940,106 | A | 6/1960 | Hopkins |
| 2,978,723 | A | 4/1961 | Hopkins |
| 3,063,419 | A | 11/1962 | Parker |
| 3,091,459 | A | 5/1963 | Lindman |
| 5,190,389 | A | 3/1993 | Vasas |
| 5,951,185 | A | 9/1999 | Kingsford et al. |
| 5,951,186 | A | 9/1999 | Lhuisset |

FOREIGN PATENT DOCUMENTS

| | | |
|---|---|---|
| FR | 90 04851 | 4/1990 |
| GB | 791938 | 3/1958 |

*Primary Examiner*—David J. Walczak
(74) *Attorney, Agent, or Firm*—Amster, Rothstein & Ebenstein

(57) ABSTRACT

A cosmetic container precludes exposure of the cosmetic within the container to the environment outside the container, even during application of the cosmetic, because, as the applicator head is used to apply the cosmetic to an intended wearer, other portions of the applicator preclude exposure of the cosmetic remaining within the container to the environment.

26 Claims, 7 Drawing Sheets

AIRTIGHT MAGNETIC APPLICATOR SYSTEM

BACKGROUND OF THE INVENTION

The present invention relates to an airtight magnetic applicator system and more particularly to such a system embodied in a cosmetic container.

Many cosmetics are in the form of a flowable powder (e.g., face powder, foundation, etc.) or a liquid containing a volatile component such as a volatile solvent (e.g., nail polish, some lipsticks and lip glosses, etc.). Such cosmetics should be stored in an airtight container to prevent loss of the powder, liquid and especially the volatile component (to preclude drying out of the cosmetic). This is not a particular problem while the cosmetic is being stored in the container with the cover thereon to provide an airtight enclosure. The problem arises once the cover is removed from the container so that the cosmetic may be removed from the container and applied to the intended wearer.

Thus, if removal of the cover from the container leaves too small an opening, it becomes difficult to remove the desired quantity of the cosmetic from the container. If removal of the cover from the container leaves too large an opening, then the exposure of the cosmetic to the atmosphere through the aperture is excessive, thereby leading either to contamination of the atmosphere outside the container or to loss or drying out of the cosmetic within the container. While the removal of the cosmetic from the container may be accomplished in a relatively brief time, typically the application of the cosmetic to the intended wearer is a substantially more lengthy process during which the cosmetic within the container and the atmosphere are in communication. Such application times may be considerable in the case of carefully applied mascara, lipstick, nail polish, and the like. The applicator is typically a brush, small scoop, glass rod, or the like projecting outwardly from the removable cover so that the applicator can be manipulated by the user employing the cover as a handle and so that the applicator head is maintained in or exposed to the cosmetic during storage. Such an applicator is part of or fixedly secured to the cover so that the cover cannot be replaced on the container (to resume the airtight integrity of the container) until application of the cosmetic has been completed.

The advantage of such an applicator/cover configuration is that the applicator head is typically in contact with the cosmetic during storage so that the residual cosmetic on the applicator head from the previous use thereof does not dry out. This is especially important in case of a liquid cosmetic containing a volatile solvent because, once the volatile solvent evaporates from the cosmetic on the applicator head, clumps of dry cosmetic are created on the applicator head and these may be resistant to resolublization by the solvent.

Accordingly, it is an object of the present invention to provide a cosmetic container wherein in one preferred embodiment the cosmetic within the container is not exposed to the environment outside the container even during application of the cosmetic.

Another object is to provide such a container wherein in one preferred embodiment the applicator head is in fluid communication with the cosmetic when the cover is on the container.

A further object is to provide such a container wherein in one preferred embodiment the applicator head may be used to apply the cosmetic to an intended wearer while other portions of the applicator preclude exposure of the cosmetic remaining within the container to the environment.

It is another object of the present invention to provide such a container which in one preferred embodiment is simple and inexpensive to produce, easy to use and maintain, and compact and attractive in configuration.

SUMMARY OF THE INVENTION

It has now been found that the above and related objects of the present invention are obtained in a cosmetic container comprising a longitudinally extending reservoir for a flowable cosmetic, the reservoir having a closed end, an open end and a magnetically-transmissive sidewall. A removable cover is provided for closing the reservoir open end, the reservoir and the cover cooperatively defining an airtight enclosure for the cosmetic. The container includes an exterior magnet and means for maintaining the exterior magnet on the exterior of the reservoir sidewall and for moving the exterior magnet between a first position adjacent the reservoir closed end and a second position adjacent the reservoir open end. A longitudinally extending applicator defines a head for transferring the cosmetic from the reservoir interior through the reservoir open end, a base carrying an interior magnet responsive to the exterior magnet for longitudinal movement therewith, and a stem connecting the head and the base such that, when the head is substantially aligned with a central longitudinal axis of the reservoir, the interior magnet is closely adjacent the interior of the reservoir sidewall and magnetically coupled with the exterior magnet for longitudinal movement therewith as a unit. Means are provided for maintaining the applicator head in substantial alignment with the central longitudinal axis of the reservoir.

Preferably the reservoir is a hollow cylinder formed of extruded glass having a closed bottom and an open top, the reservoir sidewall being of constant thickness below the open end.

In a first preferred embodiment, the container additionally includes (i) means for maintaining the applicator head in fluid communication with the cosmetic while the cover closes the reservoir open end, (ii) means for applying the cosmetic to the applicator head as the applicator head moves upwardly through the reservoir open end, and (iii) means for sealing the reservoir open end about the applicator while the applicator head is outside of the reservoir, thereby to preclude atmospheric exposure of the cosmetic within the reservoir. The sealing means seals the reservoir open end about the applicator head. Where the cosmetic includes a volatile solvent, the alignment maintaining means also maintains the applicator head in gaseous communication with the volatile solvent. The alignment maintaining means is preferably substantially disposed within the reservoir open end.

In a second preferred embodiment, the applicator stem is substantially rigid and connects the base and the head in an offset relationship. The base extends a first distance to one side of a longitudinal axis through the applicator, and the head extends a second distance to an opposite side of the longitudinal axis. Preferably the first and second distances combined are greater than the inner diameter of the reservoir open end, and the base only snugly passes through the reservoir open end.

In a third preferred embodiment, the container additionally includes a stationary flow controller extending through the reservoir open end in fluidtight relationship. The interior of the flow controller defines a central flow channel having a fluidtight sidewall, and the flow controller includes flow restricting means to limit the flow of cosmetic from the reservoir into the central flow channel. In this embodiment, preferably the applicator has a ferrule intermediate the stem and head thereof. The ferrule is configured and dimensioned to fit snugly into the central flow channel for reciprocating sliding movement relative thereto. The ferrule, cooperatively with the central flow channel, (i) precludes cosmetic flow from the reservoir into the central flow channel when the applicator head extends outwardly from the central flow channel, (ii) limits cosmetic flow from the reservoir into the central flow channel when the applicator head is totally within the central flow channel, and (iii) pumps cosmetic from the reservoir into the central flow channel and onto the applicator head as the applicator head is being extended outwardly from the central flow channel.

To summarize, the reservoir is a hollow cylinder of extruded glass having a closed bottom and an open top, and the reservoir sidewall is of constant thickness below the open top. Preferably the base extends a first distance to one side of a longitudinal axis through the applicator, and the head extends a second distance to an opposite side of the longitudinal axis, the first and second distances combined being greater than the inner diameter of the reservoir open end, and the base only snugly passing through the reservoir open end. The alignment maintaining means is substantially disposed within the reservoir open top and maintains the applicator head in gaseous communication with a volatile solvent in the cosmetic. The container additionally includes (i) means for applying the cosmetic to the applicator head as the applicator head moves upwardly through the reservoir open top, (ii) means for sealing the reservoir open top about the applicator while the applicator head is outside of the reservoir, thereby to preclude atmospheric exposure of the cosmetic within the reservoir, the sealing means sealing the reservoir open top about the applicator head, and (iii) means for maintaining the applicator head in fluid communication with the cosmetic while the cover closes the reservoir open top. The container preferably additionally includes a stationary flow controller and a ferrule. The exterior of the flow controller extends through the reservoir open end in fluidtight relationship therewith, the interior of the flow controller defining a central flow channel having a fluidtight sidewall and including flow restricting means to limit the flow of cosmetic from the reservoir into the central flow channel. The ferrule is mounted on the applicator intermediate the stem and head thereof, the ferrule being configured and dimensioned to fit snugly into the central flow channel for reciprocating sliding movement relative thereto. The ferrule is operative, cooperatively with the central flow channel, (i) to preclude cosmetic flow from the reservoir into the central flow channel when the applicator head extends outwardly from the central flow channel, (ii) to limit cosmetic flow from the reservoir into the central flow channel when the applicator head is totally within the central flow channel, and (iii) to pump cosmetic from the reservoir into the central flow channel and onto the applicator head as the applicator head is being extended outwardly from the central flow channel.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1A:
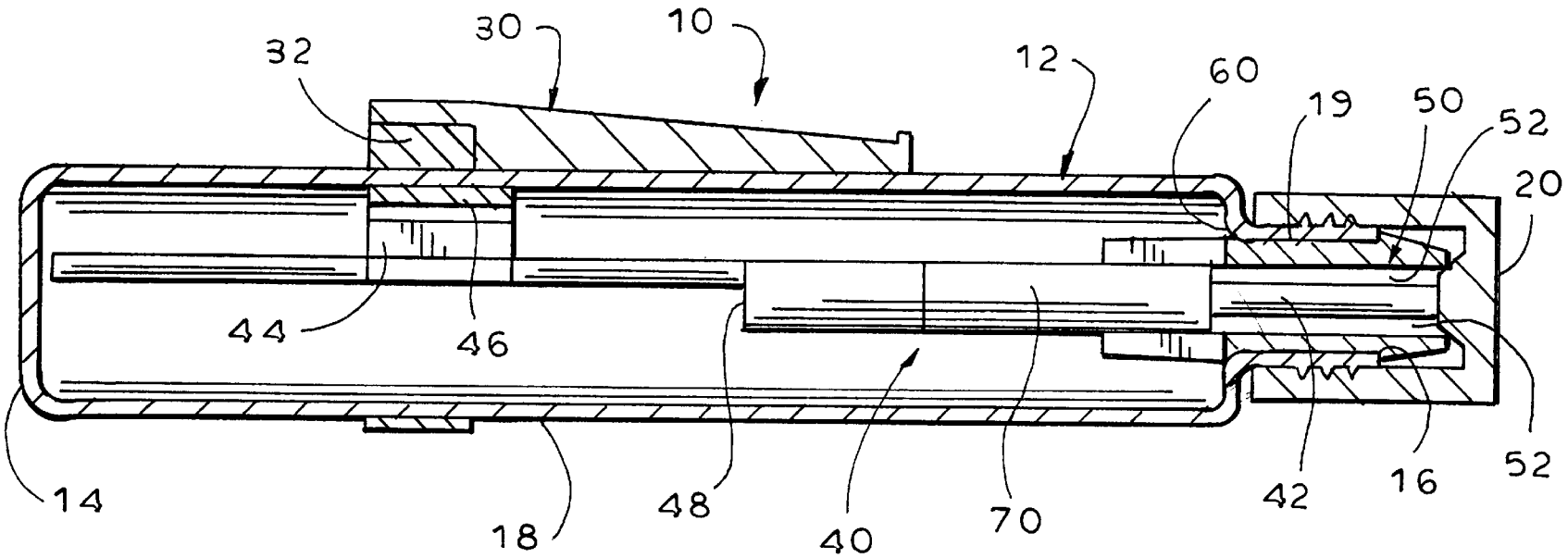
FIG. 1A is a sectional view of a cosmetic container according to the present invention.

Referring now to the drawing, and in particular to FIG. 1A thereof, therein illustrated is a cosmetic container according to the present invention, generally designated by the reference numeral 10. In its basic aspects, the container comprises a longitudinally extending reservoir, generally designated 12, the reservoir 12 having a closed end 14, an open end 16, and a magnetically-transmissive sidewall 18 connecting the ends 14, 16. A sidewall neck 19, preferably of diminished diameter relative to the remainder of sidewall 18, connects the remainder of the sidewall 18 and the open end 16.

The reservoir 12 is preferably a hollow cylinder formed of extruded glass or plastic having a closed bottom end 14 and an open top end 16. The reservoir sidewall 18 is thin and of constant thickness for most of its length below the neck 19. The use of an extrusion process for the formation of the reservoir is not only economical but facilitates obtaining the desired constant thickness of the reservoir sidewall. However an injection molding, blow molding, or like process may be used, whether with glass or plastic. While the reservoir may be formed of magnetically-transmissive materials other than glass, glass is preferred for its relative inertness to various volatile solvents and the other chemicals which might be found in a cosmetic. A preferred solvent-resistant plastic is the acrylonitrile polymer available under the trade name BARAX from BT Chemical.

Figure 1B:
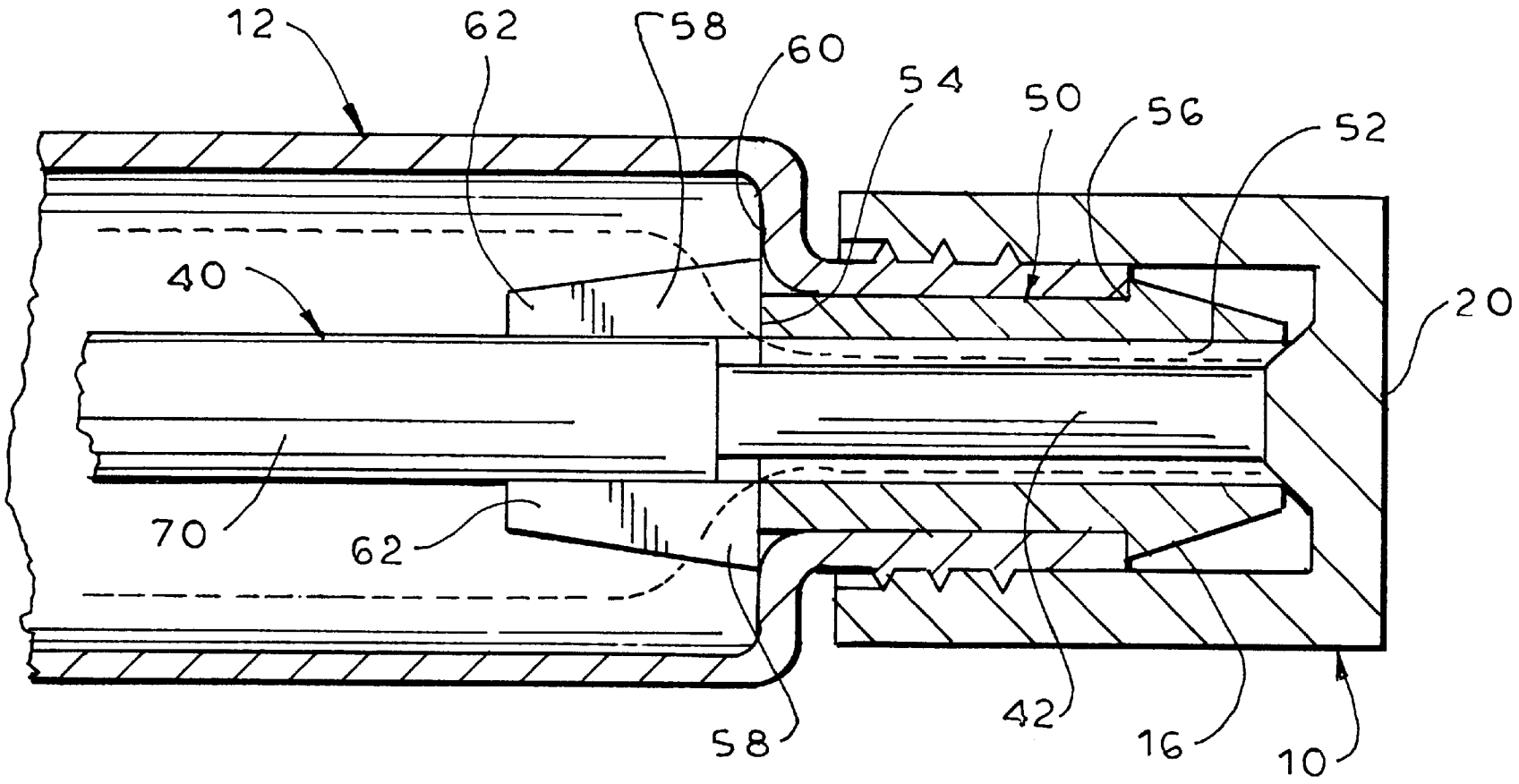
FIG. 1B is a fragmentary sectional view similar to FIG. 1A, but to an enlarged scale.

A relatively thin reservoir sidewall 18 is preferred to facilitate magnetic coupling of exterior and interior magnets through the sidewall 18, as will be explained hereinafter. While preferably the reservoir sidewall 18 is magnetically-transparent and does not interfere at all with the magnetic coupling of the exterior and interior magnets through the sidewall, as a practical matter a material which enables the magnetic coupling of the exterior and interior magnets is acceptable even though it does interfere to a limited degree. Referring now to FIG. 1B in particular, a removable cover 20 is provided for closing the reservoir open end 16, the reservoir 12 and the cover 20 cooperatively defining an airtight enclosure. The removable cover 20 and the neck 19 adjacent the open top end 16 may engage threadedly (as illustrated), frictionally, or the like. Indeed, the cover 20 need not be physically separable from the reservoir 12 so long as it can be "removed" to expose the reservoir open end 16—e.g., a displacement of the cover 20 from the open end, regardless of whether the cover is simply relocated on the reservoir 12 or actually separated therefrom.

In the context of a cosmetic container 10, the reservoir 12 contains a flowable cosmetic (not shown) whether it be a liquid or powder, and is especially adapted for containing a flowable liquid cosmetic including a volatile constituent such as a volatile solvent.

Returning now to FIG. 1A in particular, means, generally designated 30, are provided for maintaining an exterior magnet 32 on the exterior of the reservoir sidewall 18 and for moving the exterior magnet 32 between a first position generally adjacent (but typically spaced from) the reservoir closed bottom end 14 and a second position generally adjacent (but typically spaced from) the reservoir open top end 16. The maintaining means 30 partially wraps snugly around the reservoir sidewall 18, yet permits relative sliding movement of the maintaining means 30 and exterior magnet 32 along a partial length of the reservoir sidewall 18. The maintaining means 30 may or may not also permit movement of the exterior magnet 32 circumferentially about the reservoir sidewall 18. The exterior magnet 32 may be captured by the maintaining means 30 for travel therewith via a frictional fit, a resilient fit, adhesive means, or other conventional means for securing components together for travel as a unit. The outer surface of the maintaining means 30 is configured and dimensioned for easy sliding by a finger of the user in either longitudinal direction and, if desired, may incorporate a clip mechanism to enable the container 10 to be carried in a user's pocket (in an inverted orientation and with the cover 20 in place), much as a conventional pen or mechanical pencil.

A longitudinally extending applicator, generally designated 40, is also provided. The applicator 40 defines at one end a head 42 for transferring cosmetic from the reservoir interior through the reservoir open end 16 (after removal of the cover 20). The head 42 is illustrated as a longitudinally extending brush formed of bristles, but could alternatively be a simple spoon-like scoop, a length of smooth glass rod, or a like mechanism suitable for the transport and application of the cosmetic. The applicator 40 defines at the other end a base 44 for carrying an interior magnet 46. The interior magnet 46 is magnetically coupled to the exterior magnet 32 and responsive to longitudinal movement thereof (and preferably circumferential movement thereof) such that ordinarily the two magnets 32, 46 move as a unit. The base 44 may extend below the interior magnet 46 to act as a stop on retreat of the applicator head 42 into the reservoir 12.

The applicator 40 additionally defines a stem 48 connecting the applicator head 42 and the applicator base 44, preferably in a horizontally offset relationship such that, when the head 42 is substantially aligned with the central longitudinal axis of the reservoir 12, the interior magnet 46 is closely adjacent (and preferably, as shown, in slidable contact with) the interior of the reservoir sidewall 18 and magnetically coupled with the exterior magnet 32 for movement therewith as a unit. The applicator stem 48, like the base 44, is substantially rigid so that upward or downward movement of the interior magnet 46 carried by base 44 results in a corresponding movement of the applicator head 42.

The applicator 40 further includes means 50 for maintaining the applicator head 42 in substantial alignment with the central longitudinal axis of the reservoir 12.

Figure 4A:
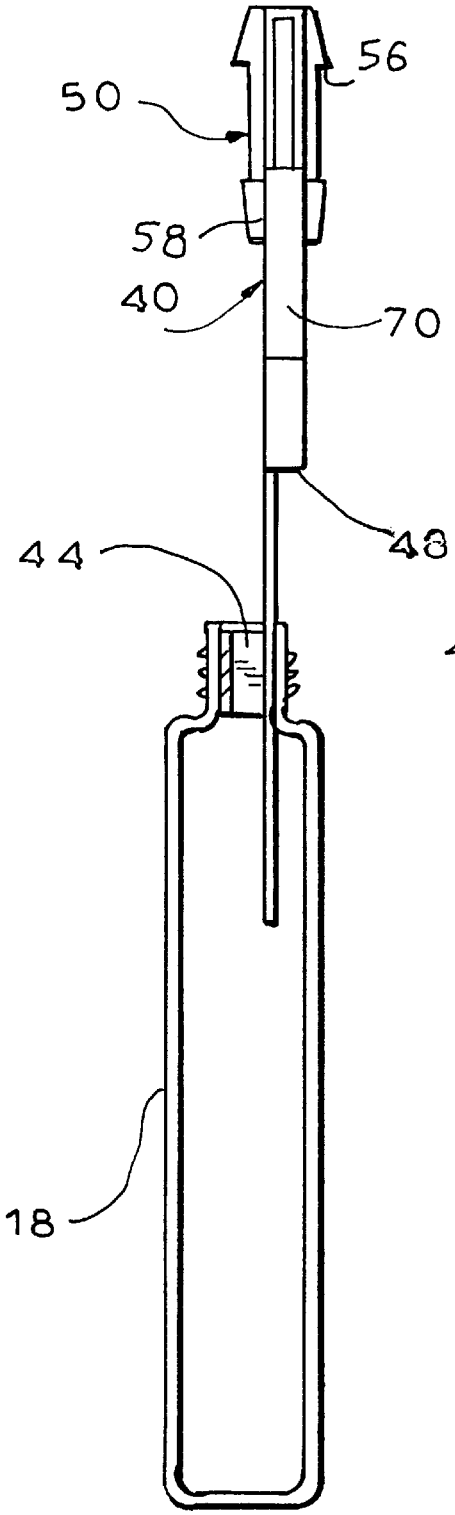
FIG. 4A is a schematic view showing the first step of the assembly process.
Figure 4B:
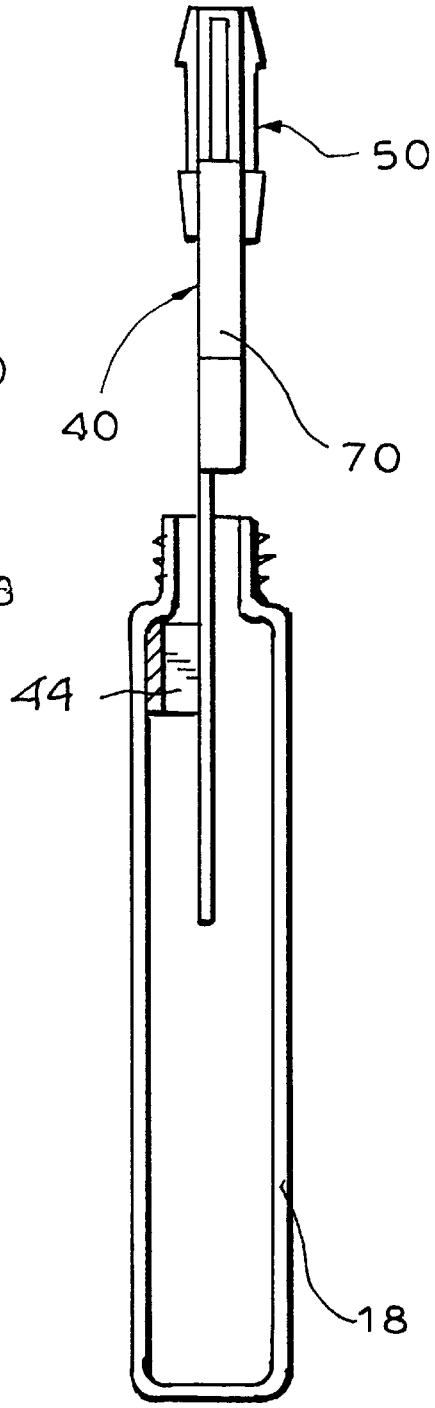
FIG. 4B is a schematic view showing the second step of the assembly process.

Referring now to FIGS. 4A and 4B in particular, the offset nature of the stem 48 facilitates insertion of the applicator 40 into the reservoir 12 while still permitting a close approach of the magnets 32, 46, limited only by the thickness of the reservoir sidewall 18. The base 44 extends a first distance L, to one side of a longitudinal axis through the applicator, and the head 42 extends a second distance $L_2$ to an opposite side of that longitudinal axis. Preferably the combined first and second distances $L_1$ and $L_2$ are greater than the inner diameter of the reservoir open end 16 (or neck 19). The offset nature of the stem allows the base 44 to snugly pass centrally through the reservoir open end 16 and neck 19 during the container assembly operation (see FIG. 4A) and then be relocated to situate the interior magnet 46 on or closely adjacent to the interior of sidewall 18, opposite the exterior magnet 32, while leaving the applicator head 42 lying substantially along the central longitudinal axis of the reservoir 12 (see FIG. 4B).

Figures 3, 5:
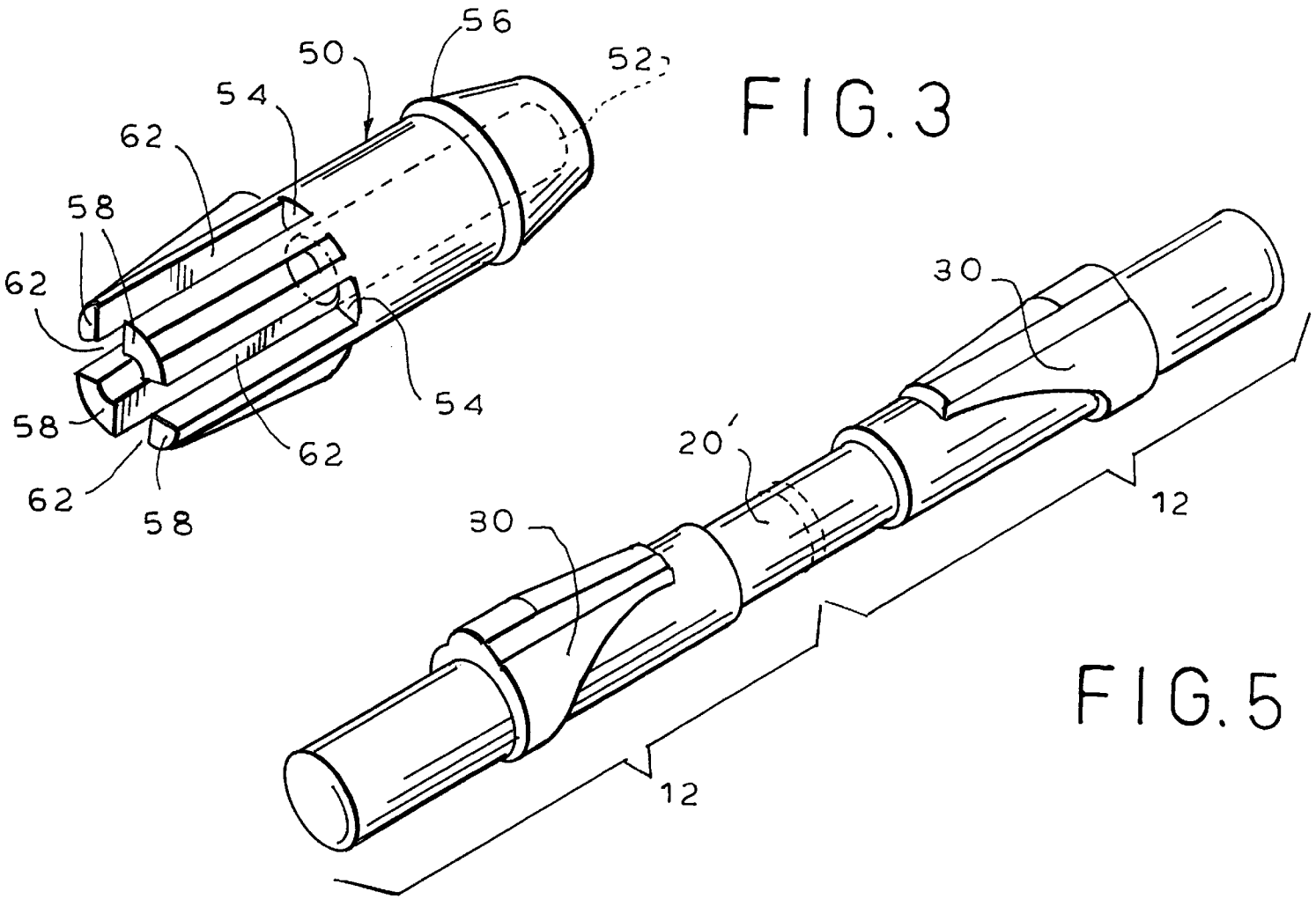
FIG. 3 is an isometric view of the flow controller.
FIG. 5 is an isometric view of a double ended cosmetic container.

In a preferred embodiment the container 10 additionally includes a stationary flow controller, generally designated 50, extending through the neck 19 and reservoir open end 16 in fluidtight relationship therewith. As best seen in FIG. 3, the interior of the flow controller 50 defines a central flow channel 52 having a fluidtight sidewall. The flow controller 50 includes flow restricting means 54 to limit the flow of cosmetic from the reservoir interior into the central flow channel 52 and also acts as a wiper to remove excess cosmetic from the applicator head 42 as it is being moved outwardly (upwardly) from reservoir 12. The flow controller 50 has an outwardly extending flange 56 adjacent the top thereof for supporting the flow controller 50 on the reservoir open end 16. The opposite end of flow controller 50 includes resilient means 58 which can resiliently collapse towards one another to enable passage of the resilient means 58 through the open end 16 and neck 19 of the reservoir 12 during the container assembly operation and then expand outwardly to abut from below the shoulder 60 formed by the reservoir neck 19. The flange 56 and resilient means 58 cooperate to prevent accidental dislodgement of the flow controller 50 from the reservoir 12.

As illustrated in FIG. 3, the resilient means are four legs 58, each adjacent pair of legs defining therebetween a channel 62 to restrict and limit the flow of cosmetic from the reservoir interior into the central flow channel 52. Clearly a different number of legs 58 and channels 62 may be used. The number, length, width and configuration of the channels 62 as well as the viscosity of the cosmetic are significant factors in determining the quantity of cosmetic which can pass into the central flow channel 52. Where the cosmetic includes a volatile constituent, the quantity of this constituent passing into the central flow channel 52 is less affected by the characteristics of the channels 62. It will be appreciated that clearly other conventional means may be employed to stabilize the position of the flow controller 50 in the container 10 and to reduce the avenues for cosmetic flow into the central flow channel 52.

The applicator 40 preferably has a ferrule 70 disposed on the stem 48 adjacent the head 42 thereof. The ferrule 70 is configured and dimensioned to fit snugly into the central flow channel 52 for reciprocating sliding movement relative thereto. The ferrule 70, cooperatively with the central flow channel 52, performs several significant functions.

Figure 2A:
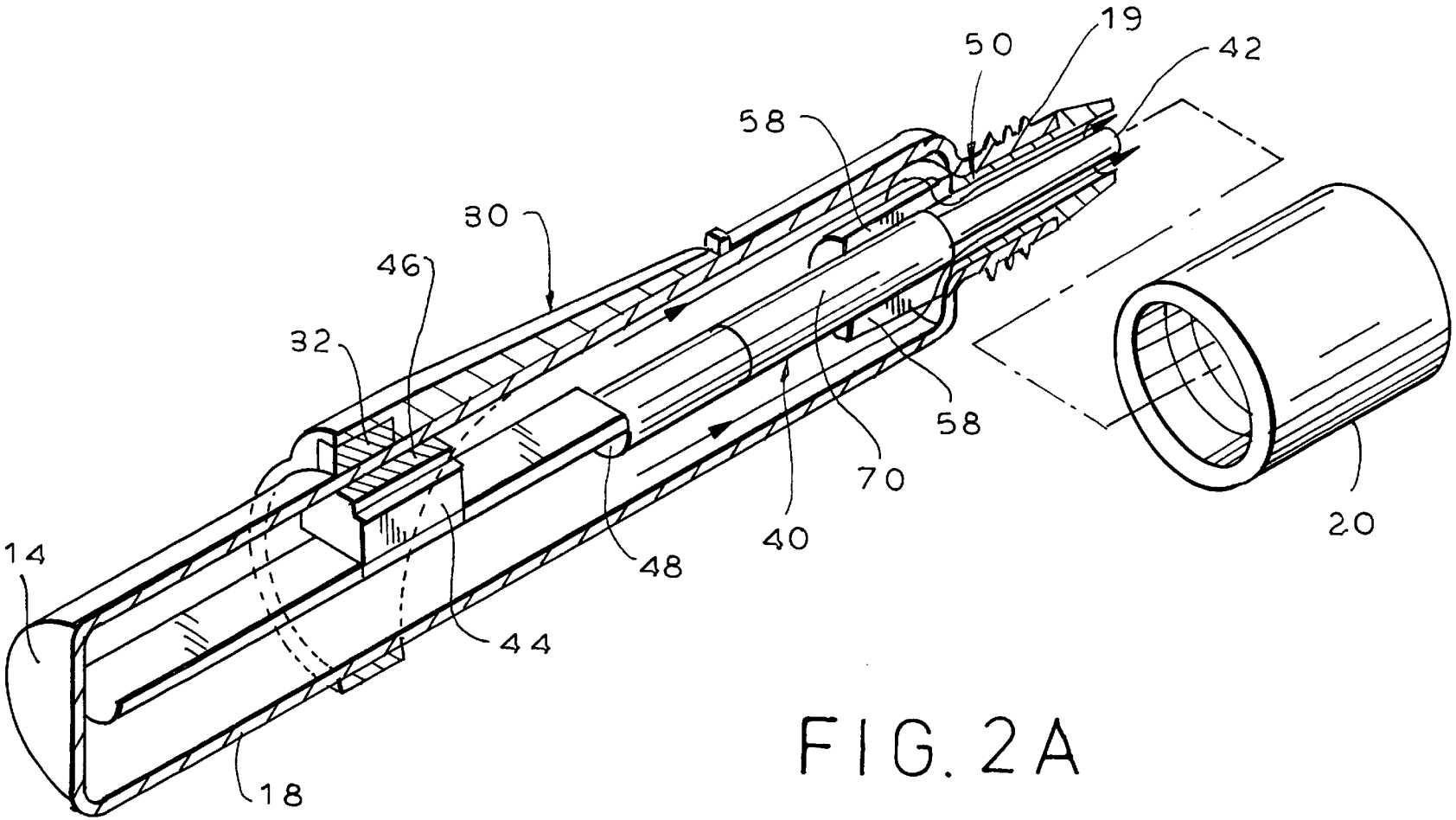
FIG. 2A is a sectional view of the cosmetic container, with the cover removed, showing the applicator fully retracted.
Figure 2B:
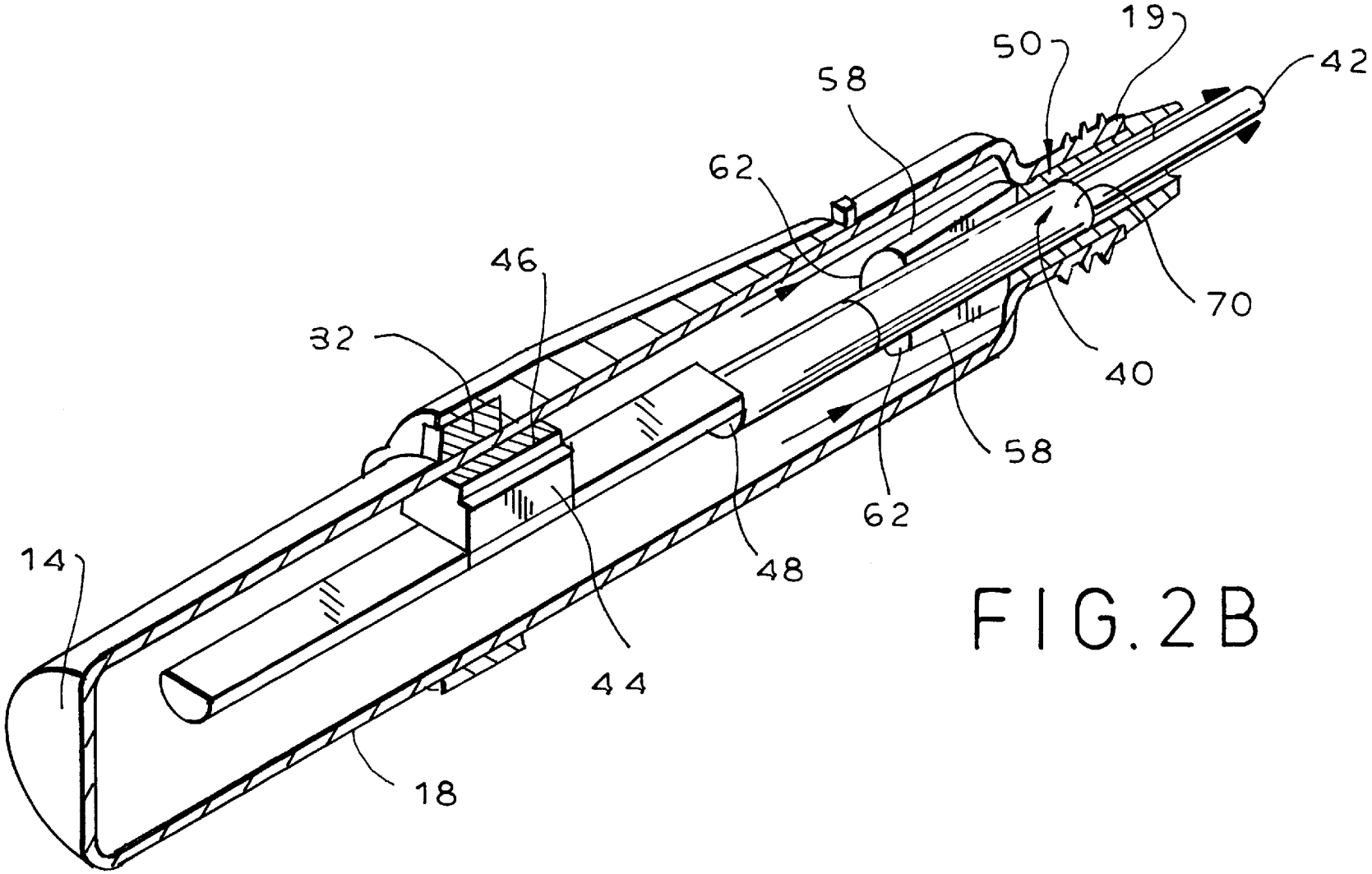
FIG. 2B is similar to FIG. 2A, but shows the applicator in the process of being extended from the container.
Figure 2C:
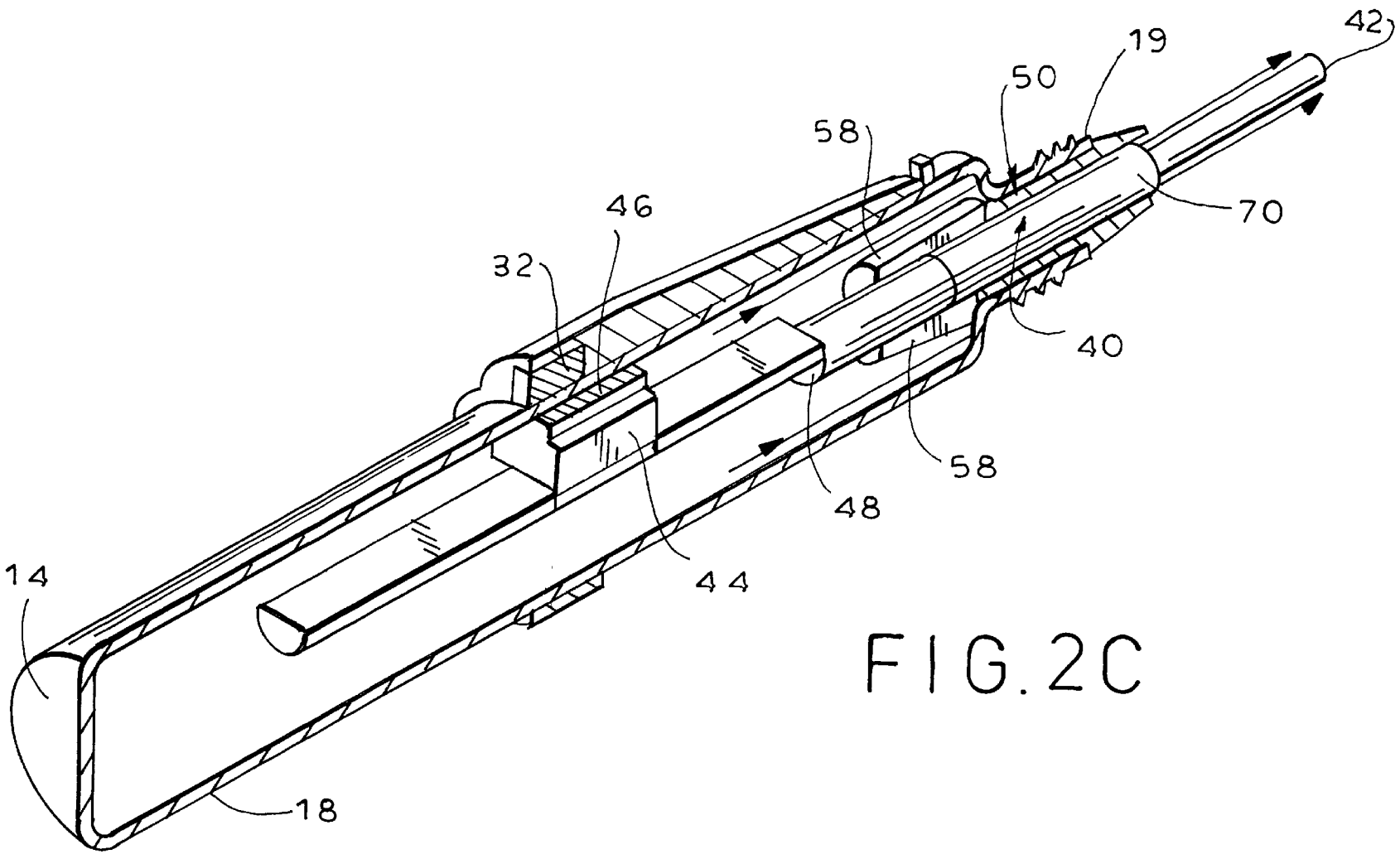
FIG. 2C is similar to FIG. 2A, but shows the applicator with the applicator head fully extended out of the container.

Referring now to FIGS. 2A through 2C in particular, the arrowed lines indicate the cosmetic flowpath as affected by the ferrule 70 and central flow channe 152.

First, when the ferrule 70 is substantially spaced below both the central flow channel 52 and the tops of the channels 62, it permits cosmetic to flow freely (when inverted, under the influence of gravity) from the channels 62 into the central flow channel 52 forwardly of the ferrule 70. Thus, as illustrated in FIG. 2A, when the applicator head 42 is totally within the central flow channel 52, the ferrule 70 is positioned to permit free flow of cosmetic into the central flow channel 52. Preferably the channels 62 defined by resilient legs 58 are of sufficient size to enable relatively free passage of cosmetic from the reservoir interior into the central flow channel 52 absent any blockage by the ferrule 70. Accordingly, in the storage position (with cover 20 in place) the applicator head 42 is maintained saturated with the cosmetic within the reservoir interior when the container 10 is inverted or in gaseous communication with any volatile solvent in the cosmetic (whether the container 10 is inverted or not). Escape of the cosmetic or volatile solvent is precluded by the presence of the cover 20 closing the reservoir open end 16.

Second, when the upper face of ferrule 70 is closely adjacent to the entrance of the central flow channel 52 (but still spaced therefrom) and not as high as the top of the channels 62, it restricts and limits (but does not preclude) cosmetic flow from the reservoir 12 into the central flow channel 52.

Third, as the ferrule 70 is driven upwardly into and through the central flow channel 52, it pumps cosmetic from the reservoir interior (and channels 62) into the central flow channel 52. Thus, as illustrated in FIG. 2B, as the applicator head 42 is being extended outwardly (upwardly) from the central flow channel 52 (in response to manual upward movement of the exterior magnet 32), the ferrule 70 acts as a piston and pumps cosmetic into and through the central flow channel 52 and from there onto the applicator head 42. Accordingly, after the cover 20 is removed and as the applicator head 42 is being advanced to a use position, the ferrule 70 drives forwardly any of the cosmetic that was intermediate the forward face of the ferrule 70 and the rear of the central flow channel 52, the cosmetic being forced either to return outwardly through the channels 62 (back into the reservoir 12) or to pass forwardly through the central flow channel 52 for discharge from the container 10.

Fourth, when the ferrule 70 is within the central flow channel 52, it precludes cosmetic flow from the reservoir interior into and through the central flow channel 52. Thus, as illustrated in FIG. 2C, when the applicator head 42 extends outwardly (forwardly) from the central flow channel 52, the ferrule 70 is positioned to block passage of the cosmetic from the channels 62 into the central flow channel 52. Accordingly, when the applicator head 42 is fully extended (i.e., above the reservoir open end 16), the ferrule 70 blocks any further communication between the cosmetic within the reservoir interior and the environment (by blocking off the central flow channel 52) so that the airtight integrity of the container 10 is resumed.

Accordingly, the combination of the ferrule 70 and the flow controller 50 provides for various functions as follows:

First, means for maintaining the applicator head 42 in fluid communication with the cosmetic via central flow channel 52 when the container 10 is stored in an inverted orientation. Where the cosmetic includes a volatile solvent, the maintaining means also maintains the applicator head 42 in gaseous communication with the volatile solvent more-or-less regardless of the container orientation. The ferrule 70 is outside of the central flow channel 52 when the cover 20 closes the reservoir open end 16, and thus not interfere with fluid flow to the applicator head 42.

Second, means for applying cosmetic to the applicator head 42 via central flow channel 52 as the ferrule 70 is moved upwardly into the central flow channel 52 and the applicator head 42 is correspondingly moved upwardly through the reservoir open end 16.

Third, means for sealing the reservoir open end 16 (that is, the central flow channel 52) about the applicator 40 while the applicator head 42 is outside of the reservoir 12 (above the open end 16), thereby to preclude atmospheric exposure of the cosmetic within the reservoir 12.

The flow controller 50 preferably extends centrally through the reservoir neck 19 and open end 16 so that it also acts as the means for maintaining the applicator head 42 in substantial alignment with the central longitudinal axis of the reservoir 12.

In order to load the applicator head 42 with the cosmetic, the applicator 40 is withdrawn to the storage position and the cover 20 placed on the reservoir 12, the container 10 is then briefly inverted (to allow the cosmetic or other flowable material to flow into and through the channel 62 and the central flow channel 52 onto the applicator head 42), and finally the container is placed in a use orientation and the applicator 40 is extended into the use position. Depending upon the characteristics of the channels 62 and the cosmetic itself, it may be possible to perform the reloading procedure (including inversion of the container) without application of the cover 20 to the container to close the open end 16 thereof.

Referring now to FIG. 5 in particular, therein illustrated is a brace of the containers 10 as previously described except that the reservoirs 12 are axially aligned so that the covers 20 are joined in head-to-head relationship in a common cover 20' for movement as a unit. This assembly facilitates the transport of two different cosmetics, whether it be cosmetics that are used jointly, for example, (a base lipstick and a lip gloss) or separately (two different shades of lipstick, one for the upper lip and one for the lower lip).

While the airtight magnetic applicator system of the present invention has been described and shown herein in the context of a cosmetic container, it will be appreciated that the principles of the present invention may find utility in a wide variety of non-cosmetic applications, particularly those where the contents is a flowable material (be it a powder, a liquid or a liquid having a volatile component therein) to be stored within the container and applied therefrom in such a manner as to minimize exposure of the contents to the environment (either to protect the environment from the contents or to protect the contents from the environment).

To summarize, the present invention provides a cosmetic container wherein the cosmetic within the container is not exposed to the environment outside the container even during application of the cosmetic, yet the applicator head is in fluid communication with the cosmetic when the cover is on the container. The applicator head may be used to apply the cosmetic to an intended wearer while other portions of the applicator preclude exposure of the cosmetic remaining within the container to the environment. The container is simple and inexpensive to produce, easy to use and maintain, and compact and attractive in configuration.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A cosmetic container comprising:

(A) a longitudinally extending reservoir for a flowable cosmetic, said reservoir having a closed end, an open end and a magnetically-transmissive sidewall, said reservoir sidewall being of constant thickness below said open end;

(B) a removable cover for closing said reservoir open end, said reservoir and said cover cooperatively defining an airtight enclosure for the cosmetic;

(C) an exterior magnet;

(D) means for maintaining said exterior magnet on the exterior of said reservoir sidewall and for moving said exterior magnet between a first position adjacent said reservoir closed end and a second position adjacent said reservoir open end;

(E) a longitudinally extending applicator defining:

(i) a head for transferring the cosmetic from the reservoir interior through said reservoir open end, (ii) a base carrying an interior magnet responsive to said exterior magnet for longitudinal movement therewith, and (iii) a stem connecting said head and said base such that, when said head is substantially aligned with a central longitudinal axis of said reservoir, said interior magnet is closely adjacent the interior of said reservoir sidewall and magnetically coupled with said exterior magnet for longitudinal movement therewith as a unit; and (F) means for maintaining said applicator head in substantial alignment with the central longitudinal axis of said reservoir.

2. The container of claim 1 wherein said reservoir is a hollow cylinder having a closed bottom and an open top.

3. The container of claim 1 additionally including means for applying the cosmetic to said applicator head as said applicator head moves upwardly through said reservoir open end.

4. The container of claim 1 additionally including means for sealing said reservoir open end about said applicator while said applicator head is outside of said reservoir, thereby to preclude atmospheric exposure of the cosmetic within said reservoir.

5. The container of claim 4 wherein said sealing means seals said reservoir open end about said applicator head.

6. The container of claim 1 additionally including means for maintaining said applicator head in fluid communication with the cosmetic while said cover closes said reservoir open end.

7. The container of claim 6 wherein the cosmetic includes a volatile solvent, and said alignment maintaining means also maintains said applicator head in gaseous communication with the volatile solvent.

8. The container of claim 1 wherein said applicator stem is substantially rigid.

9. The container of claim 1 wherein said alignment maintaining means is substantially disposed within said reservoir open end.

10. The container of claim 1 wherein said reservoir is formed of extruded glass.

11. A container for carrying two different cosmetics comprising a pair of the cosmetic containers of claim 1 wherein both said covers are joined in head-to-head relationship for movement as a unit.

12. The container of claim 1 wherein said applicator is configured and dimensioned for passage in its entirety into said reservoir through said reservoir open end during assembly of the container.

13. A container comprising:

(A) a longitudinally extending reservoir for a flowable material, said reservoir having a closed end, an open end and a magnetically-transmissive sidewall;

(B) a removable cover for closing said reservoir open end, said reservoir and said cover cooperatively defining an airtight enclosure for the flowable material;

(C) an exterior magnet;

(D) means for maintaining said exterior magnet on the exterior of said reservoir sidewall and for moving said exterior magnet between a first position adjacent said reservoir closed end and a second position adjacent said reservoir open end;

(E) a longitudinally extending applicator defining (i) a head for transferring the flowable material from the reservoir interior through said reservoir open end, (ii) a base carrying an interior magnet responsive to said exterior magnet for longitudinal movement therewith, and (iii) a stem connecting said head and said base in an offset relationship such that, when said head is substantially aligned with a central longitudinal axis of said reservoir, said interior magnet is closely adjacent the interior of said reservoir sidewall and magnetically coupled with said exterior magnet for longitudinal movement therewith as a unit; and (F) means for maintaining said applicator head in substantial alignment with the central longitudinal axis of said reservoir.

14. The container of claim 13 wherein said reservoir sidewall is of constant thickness below said open end.

15. The container of claim 13 wherein said base extends a first distance to one side of a longitudinal axis through said applicator, and said head extends a second distance to an opposite side of the longitudinal axis.

16. The container of claim 15 wherein said first and second distances combined are greater than the inner diameter of said reservoir open end.

17. The container of claim 15 wherein said base only snugly passes through said reservoir open end.

18. The container of claim 13 wherein said base extends a first distance to one side of a longitudinal axis through said applicator, and said head extends a second distance to an opposite side of the longitudinal axis, said first and second distances combined being greater than the inner diameter of said reservoir open end, and said base only snugly passing through said reservoir open end.

19. A cosmetic container comprising:

(A) a longitudinally extending reservoir for a flowable cosmetic, said reservoir having a closed end, an open end and a magnetically-transmissive sidewall;

(B) a removable cover for closing said reservoir open end, said reservoir and said cover cooperatively defining an airtight enclosure for the cosmetic;

(C) an exterior magnet;

(D) means for maintaining said exterior magnet on the exterior of said reservoir sidewall and for moving said exterior magnet between a first position adjacent said reservoir closed end and a second position adjacent said reservoir open end;

(E) a longitudinally extending applicator defining:

(i) a head for transferring the cosmetic from the reservoir interior through said reservoir open end, (ii) a base carrying an interior magnet responsive to said exterior magnet for longitudinal movement therewith, and (iii) a stem connecting said head and said base such that, when said head is substantially aligned with a central longitudinal axis of said reservoir, said interior magnet is closely adjacent the interior of said reservoir sidewall and magnetically coupled with said exterior magnet for longitudinal movement therewith as a unit;

(F) means for maintaining said applicator head in substantial alignment with the central longitudinal axis of said reservoir; and (G) a stationary flow controller extending through said reservoir open end in fluidtight relationship.

20. The container of claim 9 wherein the interior of said flow controller defines a central flow channel hazing a fluidtight sidewall.

21. The container of claim 20 wherein said flow controller includes flow restricting means to limit the flow of cosmetic from said reservoir into said central flow channel.

22. The container of claim 20 wherein said applicator has a ferrule intermediate said stem and head thereof.

23. The container of claim 22 wherein said ferrule is configured and dimensioned to fit snugly into said central flow channel for reciprocating sliding movement relative thereto.

24. The container of claim 23 wherein said ferrule, cooperatively with said central flow channel, (i) precludes cosmetic flow from said reservoir into said central flow channel when said applicator head extends outwardly from said central flow channel, (ii) limits cosmetic flow from said reservoir into said central flow channel when said applicator head is totally within said central flow channel, and (iii) pumps cosmetic from said reservoir into said central flow channel and onto said applicator head as said applicator head is being extended outwardly from said central flow channel.

25. A cosmetic container comprising:

(A) a longitudinally extending reservoir for a flowable cosmetic, said reservoir having a closed end, an open end and a magnetically-transmissive sidewall;

(B) a removable cover for closing said reservoir open end, said reservoir and said cover cooperatively defining an airtight enclosure for the cosmetic;

(C) an exterior magnet;

(D) means for maintaining said exterior magnet on the exterior of said reservoir sidewall and for moving said exterior magnet between a first position adjacent said reservoir closed end and a second position adjacent said reservoir open end;

(E) a longitudinally extending applicator defining:

(i) a head for transferring the cosmetic from the reservoir interior through said reservoir open end, (ii) a base carrying an interior magnet responsive to said exterior magnet for longitudinal movement therewith, and (iii) a stem connecting said head and said base such that, when said head is substantially aligned with a central longitudinal axis of said reservoir, said interior magnet is closely adjacent the interior of said reservoir sidewall and magnetically coupled with said exterior magnet for longitudinal movement therewith as a unit; and (F) means for maintaining said applicator head in substantial alignment with the central longitudinal axis of said reservoir;

said container being characterized in that said reservoir is a hollow cylinder of extruded glass having a closed bottom and an open top, and said reservoir sidewall is of constant thickness below said open top;

said alignment maintaining means is substantially disposed within said reservoir open top and maintains said applicator head in gaseous communication with a volatile solvent in the cosmetic; and said container additionally includes:

(i) means for applying the cosmetic to said applicator head as said applicator head moves upwardly through said reservoir open top, (ii) means for sealing said reservoir open top about said applicator while said applicator head is outside of said reservoir, thereby to preclude atmospheric exposure of the cosmetic within said reservoir, said sealing means sealing said reservoir open top about said applicator head, and (iii) means for maintaining said applicator head in fluid communication with the cosmetic while said cover closes said reservoir open top.

26. A cosmetic container comprising:

(A) a longitudinally extending reservoir for a flowable cosmetic, said reservoir having a closed end, an open end and a magnetically-transmissive sidewall;

(B) a removable cover for closing said reservoir open end, said reservoir and said cover cooperatively defining an airtight enclosure for the cosmetic;

(C) an exterior magnet;

(D) means for maintaining said exterior magnet on the exterior of said reservoir sidewall and for moving said exterior magnet between a first position adjacent said reservoir closed end and a second position adjacent said reservoir open end;

(E) a longitudinally extending applicator defining:

(i) a head for transferring the cosmetic from the reservoir interior through said reservoir open end, (ii) a base carrying an interior magnet responsive to said exterior magnet for longitudinal movement therewith, and (iii) a stem connecting said head and said base such that, when said head is substantially aligned with a central longitudinal axis of said reservoir, said interior magnet is closely adjacent the interior of said reservoir sidewall and magnetically coupled with said exterior magnet for longitudinal movement therewith as a unit;

(F) means for maintaining said applicator head in substantial alignment with the central longitudinal axis of said reservoir;

(G) a stationary flow controller, the exterior of said flow controller extending through said reservoir open end in fluidtight relationship therewith, the interior of said flow controller defining a central flow channel having a fluidtight sidewall and including flow restricting means to limit the flow of cosmetic from said reservoir into said central flow channel; and (H) a ferrule on said applicator intermediate said stem and head thereof, said ferrule being configured and dimensioned to fit snugly into said central flow channel for reciprocating sliding movement relative thereto, said ferrule being operative, cooperatively with said central flow channel, (i) to preclude cosmetic flow from said reservoir into said central flow channel when said applicator head extends outwardly from said central flow channel, (ii) to limit cosmetic flow from said reservoir into said central flow channel when said applicator head is totally within said central flow channel, and (iii) to pump cosmetic from said reservoir into said central flow channel and onto said applicator head as said applicator head is being extended outwardly from said central flow channel.

* * * * *